US006923001B2

(12) United States Patent
Laster et al.

(10) Patent No.: US 6,923,001 B2
(45) Date of Patent: Aug. 2, 2005

(54) PILOTLESS CATALYTIC COMBUSTOR

(75) Inventors: Walter Ray Laster, Oviedo, FL (US); Ramarao V. Bandaru, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 140 days.

(21) Appl. No.: 10/619,342

(22) Filed: Jul. 14, 2003

(65) Prior Publication Data

US 2005/0011194 A1 Jan. 20, 2005

(51) Int. Cl.[7] ..... F23R 3/40

(52) U.S. Cl. ..... 60/723; 60/749; 60/750; 431/170

(58) Field of Search ..... 60/39.11, 723, 60/749, 750, 777, 822; 431/7, 170

(56) References Cited

U.S. PATENT DOCUMENTS 3,156,094 A * 11/1964 Nash et al. ..... 60/39.822
4,040,252 A * 8/1977 Mosier et al. ..... 60/723
4,265,085 A 5/1981 Fox et al.
5,003,768 A * 4/1991 Kappler et al. ..... 60/723
5,826,429 A 10/1998 Beebe et al.
6,082,111 A 7/2000 Stokes
6,209,326 B1 4/2001 Mandal et al.
6,286,298 B1 9/2001 Burrus et al.
6,415,608 B1 7/2002 Newburry
6,460,339 B2 10/2002 Nishida et al.

* cited by examiner

*Primary Examiner*—Louis J. Casaregola

(57) ABSTRACT

A pilotless catalytic combustor (10) including a basket (12) having a central axis (14) and a central core region (16) disposed along a portion of the central axis. Catalytic combustion modules (18) are circumferentially disposed about the central axis radially outward of the central core region for receiving a fuel flow (20) and a first portion of an oxidizer flow (22), and discharge a partially oxidized fuel/oxidizer mixture (24) at respective exit ends (26). A base plate (30) is positioned in the central core region upstream of the exit ends of the catalytic combustion modules, the baseplate defining a recirculation zone (32) near the respective exit ends for stabilizing oxidation in the burnout zone. A method of staged fueling for a pilotless catalytic combustor includes providing fuel to at least one of the modules during start up and progressively providing fuel to other modules as a load on the turbine engine is increased.

12 Claims, 1 Drawing Sheet

PILOTLESS CATALYTIC COMBUSTOR

FIELD OF THE INVENTION

This invention relates generally to combustion turbine engines, and, in particular, to a pilotless catalytic combustor having staged fueling.

BACKGROUND OF THE INVENTION

It is known to use catalytic combustion in combustion turbine engines to reduce NOx emissions. One such catalytic combustion technique known as lean catalytic, lean burn (LCL) combustion, involves completely mixing fuel and air to form a lean fuel mixture that is passed over a catalytically active surface prior to introduction into a downstream combustion zone. However, the LCL technique requires precise control of fuel and air volumes and may require the use a complex preburner to bring the fuel/air mixture to lightoff conditions. An alternative catalytic combustion technique is the rich catalytic, lean burn (RCL) combustion process that includes mixing fuel with a first portion of air to form a rich fuel mixture. The rich fuel mixture is passed over a catalytic surface and mixed with a second portion of air in a downstream combustion zone to complete the combustion process. U.S. Pat. No. 6,415,608 describes a gas turbine engine having an annular combustor design using catalytic reactor elements in an RCL configuration. The catalytic reaction takes place in a series of annularly mounted modules, each module comprising a catalytic reactor element, a fuel injection region, a rich fuel/air mixing region, and a downstream mixing zone at the catalytic reactor element exit.

The design of a turbine engine combustor is further complicated by the necessity for the engine to operate reliably with a low level of emissions at a variety of power levels. High power operation at high firing temperatures tends to increase the generation of oxides of nitrogen. Low power operation at lower combustion temperatures tends to increase the generation of carbon monoxide and unburned hydrocarbons due to incomplete combustion of the fuel. Under all operating conditions, it is important to ensure the stability of the flame to avoid unexpected flameout, damaging levels of acoustic vibration, and damaging flashback of the flame from the combustion chamber into the fuel premix section of the combustor. A relatively rich fuel/air mixture will improve the stability of the combustion process, but will have an adverse affect on the level of NOx emissions. A careful balance must be achieved among these various constraints in order to provide a reliable engine capable of satisfying very strict modem emissions regulations. A pilot flame is commonly used to stabilize the flame during engine loading conditions. However, pilot nozzles may produce a significant portion of the NOx produced by the combustion engine. In addition, the mechanical intricacy of a pilot flame nozzle and fueling of the pilot flame introduce undesirable expense and complexity to the combustor.

Staging is the delivery of fuel to the combustion chamber through at least two separately controllable fuel supply systems or stages including separate fuel nozzles or sets of fuel nozzles. Staging is known as a method to control combustion under varying loading conditions. As the power level of the machine is increased, the number of stages brought on-line is increased to achieve a desired power level. A two-stage can annular combustor is described in U.S. Pat. No. 4,265,085. The combustor of the '085 patent includes a primary stage delivering fuel to a central region of the combustion chamber and a secondary stage delivering fuel to an annular region of the combustion chamber surrounding the central region. However, a centrally located pilot is still required in the combustor of the '085 patent, resulting in undesirable NOx production.

Accordingly, there is a need for improved control of combustion in gas turbine engines to reduce NOx formation.

BRIEF DESCRIPTION OF THE DRAWINGS

The invention will be more apparent from the following description in view of the drawings that show.

DETAILED DESCRIPTION OF THE INVENTION

Figure 1:
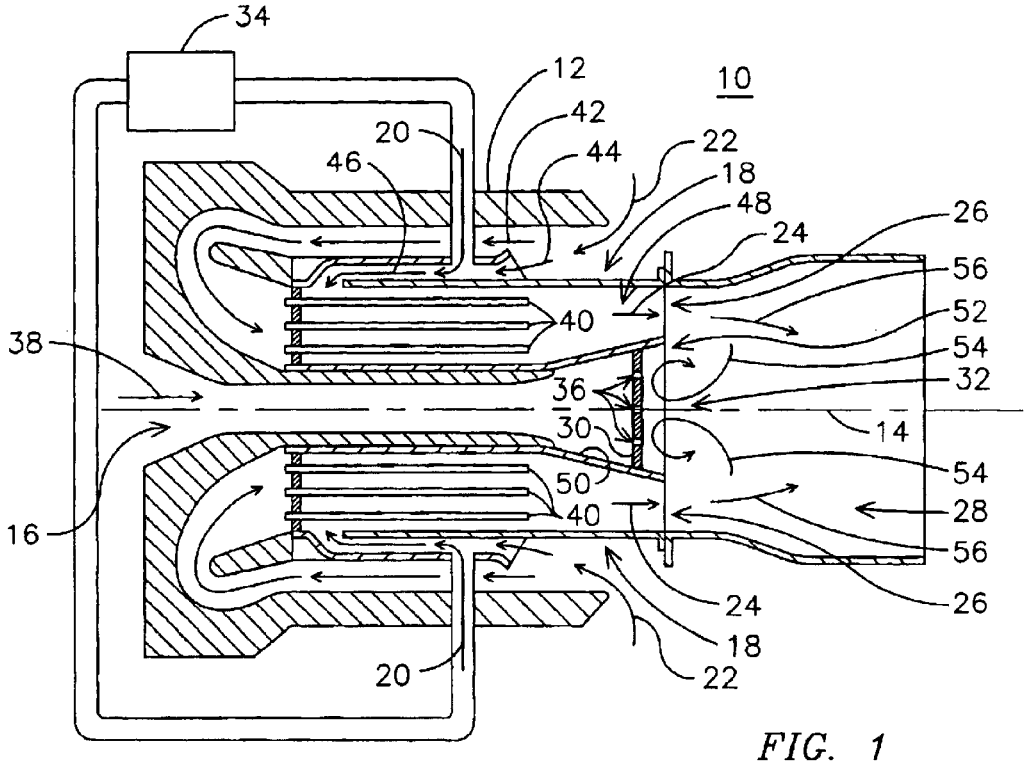
FIG. 1 illustrates a cross section of a pilotless combustor including a plurality of catalytic combustion modules radially arranged around a central core region.

FIG. 1 illustrates a cross section of a pilotless combustor 10 including a plurality of catalytic combustion modules 18 arranged around a central core region 16. The combustor includes a combustor basket 12 having a central axis 14 for retaining the combustion modules 18 circumferentially installed in the combustor basket 12, radially outward of the central core region 16. Each combustion module 18 receives a fuel flow 20 and a first portion of an oxidizer flow 22. In a backside cooling embodiment, the first portion of an oxidizer flow 22 may be split into an oxidizer mixing flow 44 for mixing with the fuel flow 20 and a oxidizer cooling flow 42 for cooling catalytic elements 40. For example, the catalytic elements 40 may include tubes coated with a catalyst on a tube outside diameter surface. The oxidizer mixing flow 44 and the fuel flow 20 can be mixed to form a fuel/oxidizer mixture 46. In one aspect of the invention, the fuel/oxidizer mixture 46 is directed to flow around the catalytic elements 40 to catalytically oxidize a portion of the fuel/oxidizer mixture 46. The oxidizer cooling flow 42 is directed to flow within the interior of the catalytic elements 40 to provide backside cooling of the fuel/oxidizer mixture 46 as the mixture 46 is partially oxidized. Alternatively, the fuel/oxidizer mixture 46 may be directed to flow within a catalytically coated interior of the catalytic elements 40, and the oxidizer cooling flow 42 may be directed to flow around the exterior of the catalytic elements 40 to provide backside cooling.

As the oxidizer cooling flow 42 exits the catalytic elements downstream, the oxidizer cooling flow 42 is mixed with the fuel/oxidizer mixture 46 in a post catalytic mixing zone 48 to form a partially oxidized fuel oxidizer mixture 24. The partially oxidized fuel oxidizer mixture 24 is then discharged into a burnout zone 28 at an exit end 26 of the combustion module 18. In an aspect of the invention, the post catalytic mixing zone 48 is gradually tapered away from the central core region so that walls 50 of each of the post catalytic mixing zones 48 of the respective modules 18 adjacent to the central core region 16 form a conic section at a downstream end 52 of the core region 16

In prior art annular type catalytic combustors, a pilot assembly is typically installed in the central core region 16 to provide a pilot flame for stabilizing the flames in the burnout zone 28 under various engine loading conditions. However, because the pilot flame is a diffusion flame, the pilot is a source of a significant amount of undesirable NOx. Typically, such piloted combustors produce 3–5 ppm of NOx. The inventors have innovatively recognized that the pilot assembly may be eliminated entirely in annular type catalytic combustors if a recirculation zone is provided sufficient to stabilize the flame in the burnout zone. By installing a base plate 30 across the central core region 16 near the exit ends 26 of the modules 18, the inventors have created a recirculation zone 32 that provides flame stabilization in the burnout zone 28, thereby allowing elimination of the NOx producing pilot. Accordingly, NOx production can be reduced to 1–2 ppm.

As shown in FIG. 1, the base plate 30 may be positioned in the central core region 16 perpendicular to the central axis 14 and upstream of the exit ends 26 of the modules 18. In one aspect, the baseplate may be positioned approximately one to two inches (2.54 to 5.08 centimeters) upstream of the exit ends 26. The partially oxidized fuel/oxidizer mixture 24 is discharged from the respective exit ends 26 of the modules 18 into the burnout zone 28. An abrupt volume change from the relatively smaller volume of the post catalytic mixing zone 48 to the larger volume of burnout zone 28, created by the baseplate 30, results in sudden expansion of the partially oxidized fuel/oxidizer mixture 24 into an expanded mixture 56. The sudden expansion of the partially oxidized fuel/oxidizer mixture 24 upon discharge from the modules 18 causes further mixing of fuel and oxidizer in the expanded mixture 56, resulting in improved flame stability. In addition, as the expanded mixture 56 flows into the burnout zone 28, a portion of the expanded mixture 56 is recirculated in the recirculation zone 32 formed by the baseplate 30, thereby further increasing flame stability. In an aspect of the invention, the baseplate 30 may include apertures 36 for allowing passage of a second portion of oxidizer flow 38 therethrough to provide cooling of the baseplate 30. Oxidizer flow 38 passing through the apertures 36 also helps prevent "dead zones" from forming in the recirculation region 32 and provides additional oxidizer to cause the expanded mixture 56 to become leaner, further reducing NOx formation. Accordingly, the complex pilot apparatus and associated pilot fueling system used in conventional catalytic combustors can be eliminated by positioning a baseplate 30 in the central core region 16 thereby creating an abrupt volume change and forming a recirculation zone 32 to provide reduced NOx formation in catalytic combustors.

While the inventors have demonstrated that creation of a recirculation zone 32 using a baseplate 30 can provide sufficient flame stabilization at base loading conditions (advantageously eliminating the need for a pilot), the inventors have also realized that it may be difficult to provide a large enough recirculation zone 32 for flame stabilization under no load conditions, such as at turbine start-up. Accordingly, the inventors have also created a novel staging method for use with the pilotless combustor of the present invention to provide the required degree of flame stabilization under no load and low load conditions.

One of the challenges of gas turbine combustor design is the wide range of loading conditions over which the turbine engine must operate. In conventional turbine engine operation, the amount of fuel provided to the turbine is increased with increasing load on the turbine. Accordingly, power output of the turbine engine is primarily controlled by fuel flow to the turbine, while air flow is kept relatively constant. As a result, a comparatively richer mixture is providing to the turbine under loading conditions because of the increased fuel flow, while a leaner mixture is provided under low loading conditions because of a reduced fuel flow. For example, at base load, a combustor is typically operated at a low air/fuel ratio (AFR), or a comparatively rich air fuel mixture. At low or no load operating conditions, the combustor operates at a high air/fuel ratio (AFR), or a comparatively lean air fuel mixture approaching the flammability limits of the mixture. Consequently, at low load conditions, stability of the flame may be compromised due to the high AFR. As a result, prior art combustors used a pilot to form a region having a higher fuel concentration to increase flame stability at no load and low load conditions. To achieve flame stability at low load conditions without using a pilot as described herein, the inventors have innovatively created a method of fuel staging to be used in conjunction with the recirculation zone 32 of the current invention.

The novel fuel staging method includes providing fuel to at least one but not all of the catalytic combustion modules 18 of the combustor 10 during start up of the turbine engine. The method further includes progressively providing fuel to the other modules 18 of the combustor 10 as a load on the turbine engine is increased, until all of the modules 18 are fueled when a predetermined base load is applied to the turbine engine. For example, in a six combustion module 18 annular combustor 10 arrangement, one module 18 is fueled at startup, three modules are fueled at about 20 percent of a base load rating, and all six modules are fueled at about 50 percent of a base load rating. By providing fuel to just one module 18 during start up, all of the fuel that would conventionally be distributed among the six modules 18 is concentrated locally in one module, creating a richer mixture in the fueled module 18, thereby decreasing the local AFR of the module 18 and increasing flame stability in the burnout zone 28. The richer fuel mixture achieved in this manner also ensures that the fueled module operates close to design conditions throughout the load range.

As more fuel is required for increasing loading conditions, the overall AFR for the combustor 10 decreases as more fuel is added and more modules can be fueled while still maintaining stability of the flame in the burnout zone 28. Accordingly, flame stability over the range of operating conditions can be provided without the use of a pilot.

Figure 2:
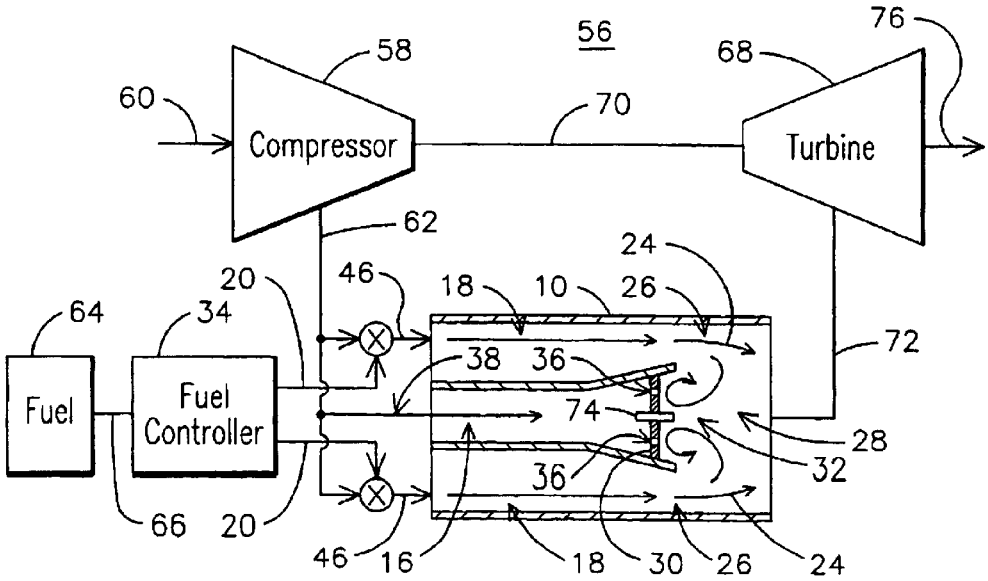
FIG. 2 is a functional diagram of a combustion turbine engine having a pilotless combustor.

FIG. 2 illustrates a combustion turbine engine 56 including a pilotless catalytic combustor 10 having a recirculation region 32 that can be used with the inventive staging method for improved catalytic combustion. The engine 56 includes a compressor 58 for receiving a flow of filtered ambient air 60 and for producing a flow of compressed air 62. Combustible fuel 66, such as natural gas or fuel oil, is provided by a fuel source 64 to the fuel controller 34. The fuel controller 34 provides independently controlled fuel flows 20 to each catalytic combustion module 18 in the combustor 10. According to the inventive method, the fuel flow 20 to each module 18 can be regulated so that only one module 18, a subset of all the modules 18, or all the modules 18 are fueled, depending on the load on engine 56. Each fuel flow 20 is mixed with the compressed air 62 to create a fuel/oxidizer mixture 46 for introduction into respective modules 18. In addition, the second portion of the oxidizer, or compressed air, flow 38 may be directed into the central core region 16, for example, for providing cooling of the baseplate 30 positioned in the central core region 16.

The fuel-oxidizer mixture 46 is partially combusted in each fueled module 18 of the combustor 10 to create partially oxidized fuel/oxidizer mixtures 24 discharged into the burnout zone 28. The baseplate 36 forms a recirculation region 32 near the exit ends 26 of the respective modules 18 to provide flame stability in the burnout zone 28. According to the invention, flame stability in the burnout zone 28 can be further enhanced by selectively fueling modules 18 so that the local AFR at the module exit ends 26 are sufficiently low. In another aspect, the baseplate may also include an igniter 74 for lighting off the combustor 10.

A turbine 68, receives hot combustion gas 72 discharged from the burnout zone 28, where it is expanded to extract mechanical shaft power. In one embodiment, a common shaft 70 interconnects the turbine 68 with the compressor 72, as well as an electrical generator (not shown) to provide mechanical power for compressing the ambient air 60 and for producing electrical power, respectively. The expanded combustion gas 68 may be exhausted directly to the atmosphere or it may be routed through additional heat recovery systems (not shown).

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A catalytic combustor comprising:

a plurality of catalytic combustion modules circumferentially disposed about a central axis radially outward of a central core region, for receiving a fuel flow and an oxidizer flow and for discharging a partially oxidized fuel/oxidizer mixture at respective exit ends, the central core region containing no burner apparatus;

a burnout zone disposed downstream of the exit ends for receiving the partially oxidized fuel/oxidizer mixture and for completing oxidation of the partially oxidized fuel/oxidizer mixture; and a base plate positioned in the central core region upstream of the respective exit ends of the plurality of catalytic combustion modules, the baseplate and the respective exit ends defining a recirculation zone for the partially oxidized fuel/oxidizer mixture for stabilizing oxidation in the burnout zone.

2. The combustor of claim 1, wherein the recirculation zone is disposed along the central axis.

3. The combustor of claim 1, further comprising a fuel flow controller for independently controlling the fuel flow to at least one of the catalytic combustion modules independently of other catalytic combustion modules, the fuel flow controller responsive to a turbine load condition.

4. The combustor of claim 1, the base plate further comprising an aperture for allowing passage of a portion of the oxidizer flow into the burnout zone bypassing the plurality of catalytic modules.

5. The combustor of claim 1, further comprising an igniter positioned proximate the baseplate.

6. The combustor of claim 1, wherein the base plate is positioned about one to two inches (2.54 to 5.08 centimeters) upstream of the respective exit ends.

7. A gas turbine engine comprising:

a compressor;

a turbine; and a catalytic combustor comprising a plurality of catalytic combustion modules circumferentially disposed about a central axis radially outward of a central core region, for receiving a fuel flow and an oxidizer flow and for discharging a partially oxidized fuel/oxidizer mixture at respective exit ends, the central core region containing no burner apparatus; a burnout zone disposed downstream of the exit ends for receiving the partially oxidized fuel/oxidizer mixture and for completing oxidation of the partially oxidized fuel/oxidizer mixture; and a base plate positioned in the central core region upstream of the respective exit ends of the plurality of catalytic combustion modules, the baseplate and the respective exit ends defining a recirculation zone for the partially oxidized fuel/oxidizer mixture for stabilizing oxidation in the burnout zone.

8. The gas turbine engine of claim 7, wherein the recirculation zone is disposed along the central axis.

9. The gas turbine engine of claim 7, further comprising a fuel flow controller for independently controlling the fuel flow to at least one of the catalytic combustion modules independently of other catalytic combustion modules, the fuel flow controller responsive to a turbine load condition.

10. The gas turbine engine of claim 7, the base plate further comprising an aperture for allowing passage of a portion of the oxidizer flow into the burnout zone bypassing the plurality of catalytic modules.

11. The gas turbine engine of claim 7, further comprising an igniter positioned proximate the baseplate.

12. The gas turbine engine of claim 7, wherein the base plate is positioned about one to two inches (2.54 to 5.08 centimeters) upstream of the respective exit ends.

* * * * *